US006881144B2

(12) United States Patent
Hansen et al.

(10) Patent No.: US 6,881,144 B2
(45) Date of Patent: Apr. 19, 2005

(54) EXTERNALLY BAFFLED RIDGE VENT AND METHODS OF MANUFACTURE AND USE

(75) Inventors: Jeff Hansen, Cedar Hill, TX (US); Dustin Ciepliski, The Colony, TX (US)

(73) Assignee: Air Vent Inc., Dallas, TX (US)

( * ) Notice: Subject to any disclaimer, the term of this patent is extended or adjusted under 35 U.S.C. 154(b) by 212 days.

(21) Appl. No.: 10/610,067

(22) Filed: Jun. 30, 2003

(65) Prior Publication Data

US 2004/0266331 A1 Dec. 30, 2004

(51) Int. Cl.[7] ..... F24F 7/02
(52) U.S. Cl. ..... 454/365; 52/199; 52/198
(58) Field of Search ..... 454/365, 366; 52/198, 199

(56) References Cited

U.S. PATENT DOCUMENTS 5,772,502 A 6/1998 Smith
6,128,869 A 10/2000 Brotherton et al.
6,227,963 B1 5/2001 Headrick
6,233,887 B1 5/2001 Smith
6,260,315 B1 7/2001 Smith
6,308,472 B1 * 10/2001 Coulton et al. ..... 52/198
6,361,434 B1 3/2002 Brandon
6,450,882 B1 9/2002 Morris et al.
6,684,581 B1 * 2/2004 Robinson et al. ..... 52/198

OTHER PUBLICATIONS

"The Lomanco Balance", 1 sheet product literature.
Solar Group, Inc. Shingle–Over, 2 sheets product literature.

* cited by examiner

*Primary Examiner*—Derek S. Boles
(74) *Attorney, Agent, or Firm*—Duane Morris LLP

(57) ABSTRACT

Ridge vents, methods of their manufacture, and methods of their use are provided. The preferred ridge vent includes an elongated flexible member having a central panel portion comprising support means for supporting the central panel above a roof, a pair of side portions containing a vent opening and a baffle. The baffle is adjustable from a relatively flat position to a relatively vertical position with respect to the roof. Having an adjustable baffle permits the ridge vent to be rolled more easily, and assists in lower cost molding of the vent.

21 Claims, 5 Drawing Sheets

EXTERNALLY BAFFLED RIDGE VENT AND METHODS OF MANUFACTURE AND USE

FIELD OF THE INVENTION

The present invention related generally to ridge vents for covering the opening of the roof ridge, and more particularly to rollable, baffle and ridge vent assemblies.

BACKGROUND OF THE INVENTION

In the winter, household activities, such as cooking, showering and doing the laundry, generate moisture that can damage the attic insulation and building materials of the roof. In the summer, attic temperatures can rise to over 150° F., which can cause premature aging and cracking of wood and roofing materials. These elevated temperatures can also increase cooling costs for the home owner. In the construction of rooves, therefore, it is often desirable to provide a ventilation opening at the roof ridge and cover it with a vent. Ridge vents are passive ventilation systems which provide openings through which air can convectively flow to and from under the roof structure to provide ventilation.

Ridge vents typically cover any elongated opening, such as one that is formed in a roof and that extends along the peak of the roof, with the opening typically being in the range of about 10–20 cm in width and running along a substantial portion of the roof peak. Typical ridge vents include "shingle-over roof ridge vents" and exposed roof vents. See for example U.S. Pat. Nos. 6,361,434; 6,233,887; 6,450,882; 6,260,315 and published U.S. Application 2002/0100232A1, all of which are incorporated herein by reference.

Many ridge vents have been developed that are made of polymeric materials that are flexible along a longitudinal axis in order to permit the ridge vent to conform to the sloped sides of a roof to cover the ridge opening. These ridge vents typically include a plurality of vents and supporting structures that depend from a common panel and that serve both the functions of resisting entry of precipitation, insects, and foreign manner, while providing supportive structures that lift the panel away from the roof and provide crush resistance. It is further desirable that ridge vents have means to create a "Venturi effect" or air draft to draw hot air outwardly from the underlying attic.

Prior art roof ridge vents are known that can be rolled for compact packaging and transport to an installation site. However, to make these ridge vents rollable requires some sacrificing of thermal efficiency in drawing hot air from the underlying attic, or costly modifications to the baffle structure in order to allow the ridge vent to be rolled in a spiral form. See U.S. Pat. No. 6,233,887 col. lines 50–61 and col. to lines 45–55.

Accordingly, there remains a need for a ridge vent, and particularly a rollable roof ridge vent which can be made cost-effectively, and which efficiently assists convection of heat and moisture from beneath a roof.

SUMMARY OF THE INVENTION

In a first embodiment of this invention, a ridge vent for covering an opening of a roof ridge is provided. The vent includes an elongated flexible member having a central panel, a pair of longitudinal side portions, and a pair of transverse ends. The side portions each contain a vent opening, and a baffle disposed laterally from said vent opening. The central panel portion includes a plurality of support ribs for supporting said central panel portion above said roof. The flexible member can be rollable into a spiral form for compact storage and transport. The baffles of this embodiment are oriented in a first direction relative to the central panel portion in said roll prior to installation, and in a second direction relative to said central portion after said installation.

The preferred embodiments of this invention can be molded such that the external baffle is generally flat (±30°) in relation to the central panel, or in relation to roof it is eventually placed on. The baffle is then lifted up into position during installation, either manually or naturally by the shape or design of the baffle itself. Lifting the baffle manually preferably employs the use of clips or stand-offs. The clips can snap on or between the louvers of the vent opening, or at another location along with flexible member and hold the baffle up vertically (±30°) such as to create a cavity in the baffle for assuring the desired Venturi effect. Stand-offs can also be used in the preferred designs to maintain the vertical orientation of the baffles and keep the baffles a designated distance from the loovers or vent opening.

The baffles can also be vertically oriented externally by the use of stand-offs which force the baffles vertical. Internal and/or external stand-offs can be employed simultaneously to hold the baffle vertical and hold the baffle a set distance away from the loovers. Alternatively, by imposing stresses, or reinforcing ribs, for example, in the right locations during the molding or fabrication of the ridge vent, the baffles can be oriented in a flattened position when the vent is rolled, and then they can spring back once the vent is unrolled. These stresses, and or reinforced portions of the vent, can help insure that the baffle is always naturally in a vertical orientation once installed.

BRIEF DESCRIPTION OF THE DRAWINGS

The accompany drawings illustrate preferred embodiments of the invention as well as other information pertinent to the disclosure, in which.

DETAILED DESCRIPTION OF THE INVENTION

Figure 1:
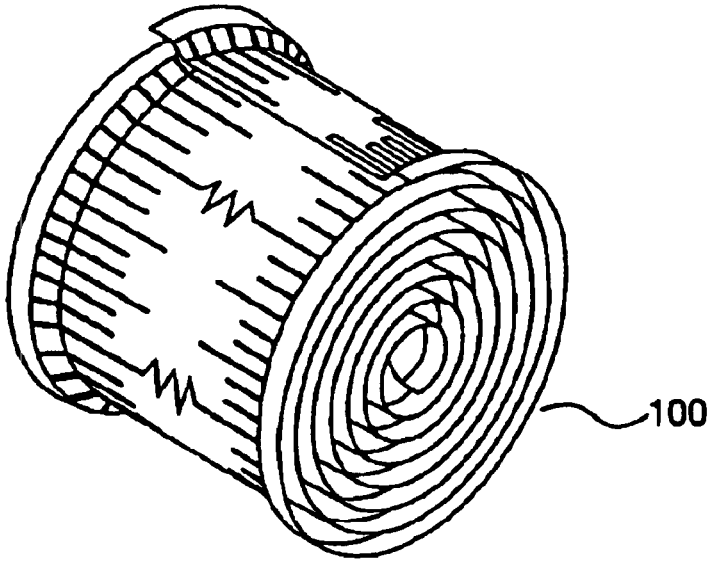
FIG. 1 is a front perspective view of a rolled ridge vent of the present invention.

This invention provides ridge vents which can be used in shingle-over roof vent applications, roll-out shingle over roof ridge vent applications, and in the applications where shingles are not employed over the vent. In addition, methods of installing these ridge vents, and methods of manufacturing them are provided. The roof vents of this invention can be designed for ridge and hip roof applications, they can have a low profile for a minimum accented ridge line. The vent opening or louver openings are preferably designed to keep out insects and weather infiltration, and the external baffles are desirably structured to deflect wind and rain and create negative air pressure ("Venturi effect"). The air vents of this invention create a balanced system of intake and exhaust through the attic for provided greater airflow than conventional roof vents or turbine vents. The preferred external baffles are desirably molded into the roof vent in such a way that they can be readily rolled into a coil laid out over an opening in a roof vent, and positioned in their final form easily, and without significant additional cost to the installer.

With respect to the drawings, and in particular, FIGS. 1–5 thereof, a ridge vent 101 is provided for covering an opening of a roof ridge. The ridge vent 101 is preferably rollable into a spiral coil 100, but can be equally provided in a fixed or more rigid form.

The ridge vent 101 includes an elongated flexible member having a central panel portion 11, a pair of longitudinal side portions and a pair of transverse ends. The central panel portion 11 includes a plurality of support ribs 18 for supporting the central panel portion 11 above a roof. Each of the side portions contains a plurality of channels, e.g., formed by the support ribs 18, for directing air current, a vent opening, and a baffle 14 disposed laterally from the vent opening. The baffles 14 are originally disposed in a first direction, for example in a relatively flat position, or substantially parallel (±30°) with the proximate central panel portion 11 or roof, for at least a period of time prior to insulation, and are then oriented in a second direction, which is generally perpendicular to (±30°) or upright in relation to the roof or proximate central panel portion 11.

Figure 2:
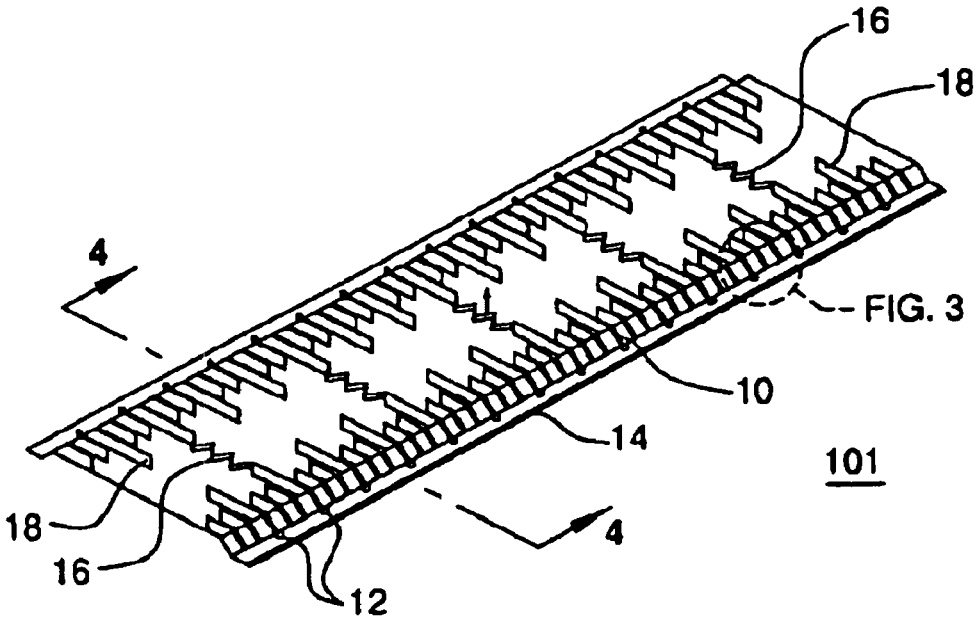
FIG. 2: is a top perspective view of the preferred ridge vent, in which the top of the central panel portion has been cut away.
Figure 3:
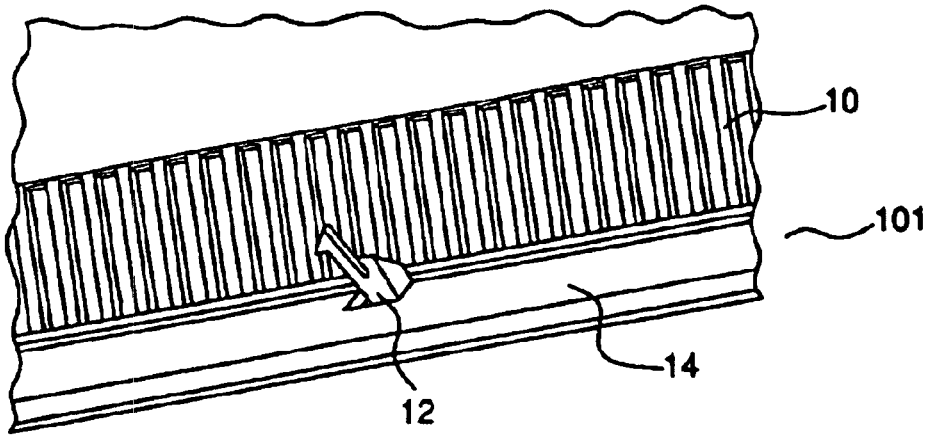
FIG. 3: is an enlarged view of the louver and baffle portion of the ridge vent of FIG. 2, showing a preferred clip for creating a fixed distance between the baffle and the louvers.
Figure 4:
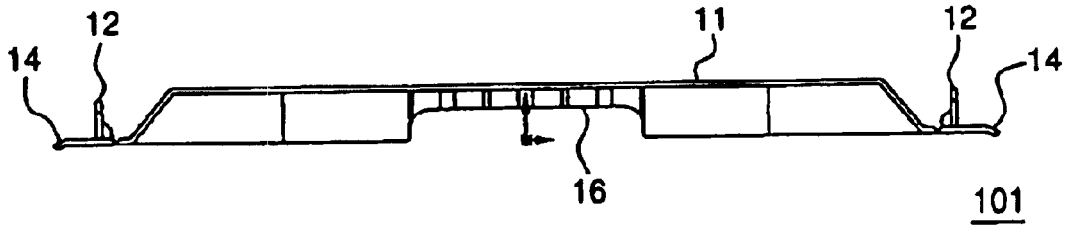
FIG. 4: is a cross-sectional side plan view, taken through line 4—4, of the ridge vent section of FIG. 2, without the cutout.
Figure 5:
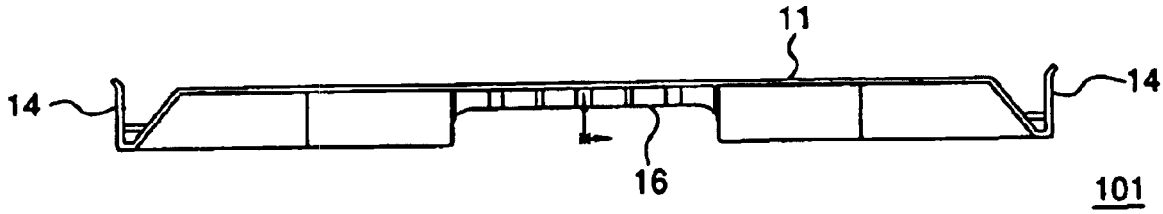
FIG. 5: is a side-plan view of the ridge vent cross-section of FIG. 4, showing the baffles disposed in their final position.

The ridge vent 101 embodiment of this invention is preferably constructed from a polymer material, such as polypropylene, polyvinylchloride, or polyethylene, and more preferably from high impact copolymer polypropylene. The ridge vent 101 laid over, or roll 100 can be unrolled over an opening in a roof ridge. The central panel portion 11 preferably includes a plurality of support ribs 18 which in the most preferred embodiment are about 1/16" in thickness and about 2–4" in length. Preferably, the ribs alternate in 2" or 4" lengths as shown in FIG. 2 forming channels there between. The support ribs 18 preferably terminate laterally in a sloping surface, coextensive with a vent opening. The vent opening is preferably protected by a series of louvers 10, but a screen or partially obstructed opening of any kind will do. The louvers 10 and channel desirably direct air current from under the roof and from the outside to the attic. The louvers 10 are preferably inclined at about 45° from the central panel 11. Extending from the bottom of the longitudinal side portions of the elongated flexible member are baffles 14, which are preferably integrally molded with the ridge vent 101, but can be separately attached to the ridge vent, such as by, adhesive, melting bonding or ultrasonic welding. The slots in the vent opening are preferably between 1/16–1¼" in width, and are designed to keep out insects and weather infiltration, such as snow, rain and hail.

The external baffles 14 are most desirably integrally formed with the ridge vent 101, and form a portion of the longitudinal side portions of the ridge vent 101. They are designed to deflect wind and rain and create negative air pressure, or a Venturi effect to draw hot air outwardly from within the underlying attic. In most rollable ridge vents, the baffle is a separate item which is inserted under the ridge vent during installation. In U.S. Pat. No. 6,361,434, a rollable baffle and ridge vent combination is disclosed. The ridge vent of the '434 patent includes a fixed baffle having a plurality of deformed triangles to permit it to collapse in accordion fashion upon itself during rolling. A similar undulated sidewall in the baffle to permit the vent to be rolled without significant distortion is disclosed in Smith, U.S. Pat. No. 6,260,315. In the preferred embodiment 101 of the present invention, the baffle is preferably manufactured with the vent in a one piece construction with the baffle oriented in a first direction, followed by maneuvering the baffle 14, either manually or naturally, into a second operable direction during the installation of the ridge vent on a roof ridge opening. This permits the roof vent to be rolled much more easily, and permits more cost-efficient manufacturing methods, such as index injection molding.

Figure 8:
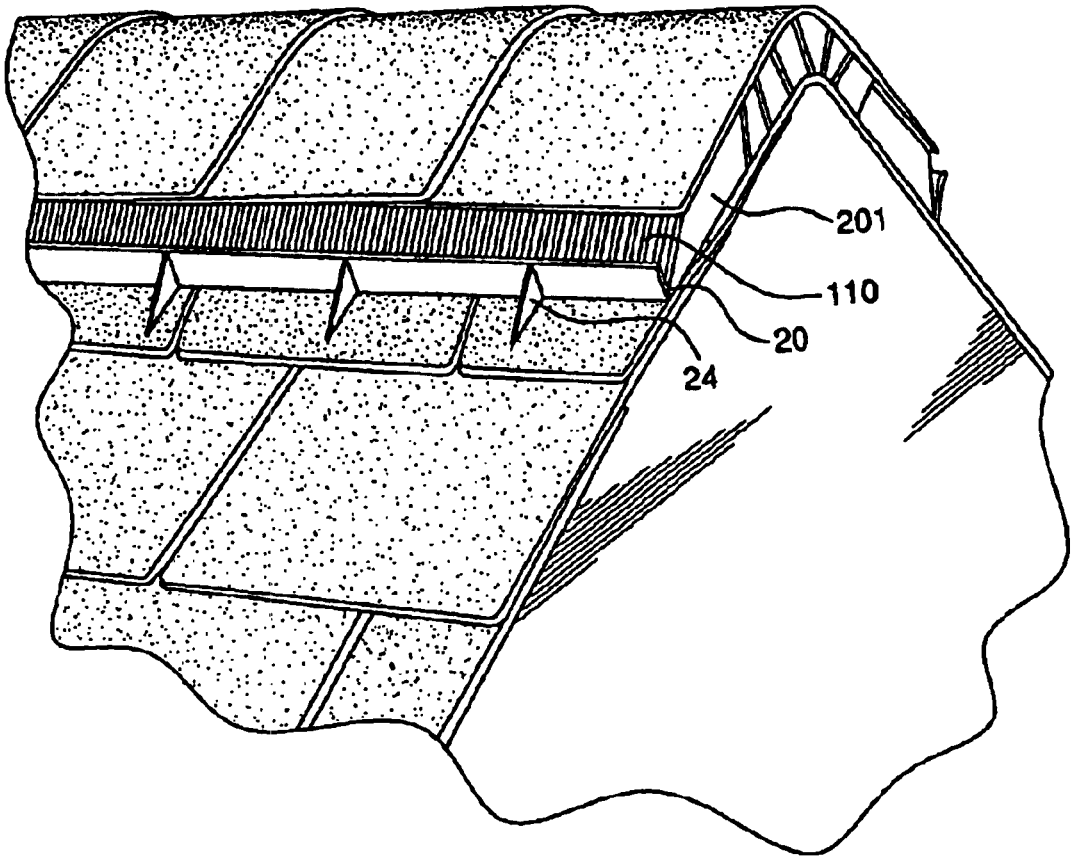
FIG. 8: is a front perspective partial view of a roof ridge employing the roof vent of FIG. 7 and a shingle—over vent construction.

With respect to the details of FIGS. 2–5, the preferred ridge vent 101 further includes an internal gusset 16 for connecting selective supporting ribs 18 in the central panel portion 11 of the ridge vent 101. A plurality internal gussets 10 are desirably molded or manufactured at the same time as the remaining portions of the ridge vent 101, and can contain the same polymer composition, a different or more rigid polymer composition, or a metallic insert for example. As shown in the enlarged view of FIG. 3, the baffles 14 can include optional louver spacer clips 12 which can clip between louvers 10, or rest on a surface of a louver 10, or some other vent surface, to provide a predesignated spacing between the baffles 14 and the louvers 10 to create the desired negative air pressure or Venturi effect. In the ridge vent embodiment 101 of FIGS. 4 and 5, the baffles are oriented in a generally flat position with their louver spacer clips 12 being substantially perpendicular to the central portion 11. The baffles 14 at this time, are generally parallel with the surface of the central portion 11 or the roof, if installation is imminent. Following the unrolling of the ridge vent roll 100 into a position on a ridge opening, the baffles 14 are moved from a first orientation to a second orientation, which is generally perpendicular to the nearest or proximate central portion 11 and, which is also generally perpendicular to the roof as shown in FIG. 8. The louver spacer clips 12 can be intermittently disposed along the baffle 14, in a preferred spacing of about 12". The clips 12 can be integrally formed in the vent mold, or separately attached as described herein connection with the baffles 14.

Figure 7:
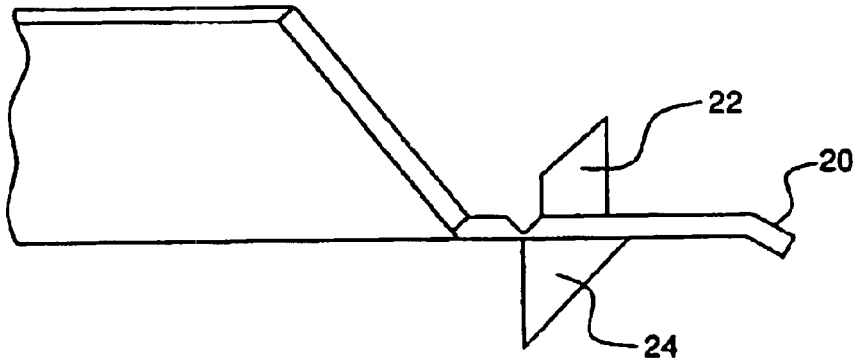
FIG. 7: is a side perspective, partial and cross-sectional view of the additional baffle support of FIG. 6 for use in disposing the baffle in an upright position.
Figure 6:
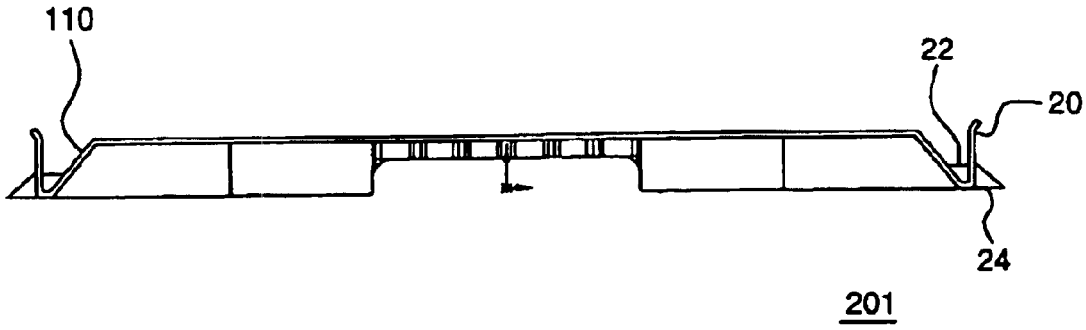
FIG. 6: is a side plan, cross-sectional view of an additional ridge vent of this invention employing a different baffle construction.

An alternative baffle design of ridge vent 201 is shown in FIGS. 6–8. The alternative baffle 20 is also preferably oriented in a first direction prior to use, and in a second direction, after it is installed, such as disclosed in FIGS. 6 and 7. The alternative baffle 20 includes a louver spacer portion 22 and a baffle support 24. As shown in FIG. 7, the louver spacer portion 22 aligns with the generally 45° surface of the louvers 10, while the baffle support 24 forms a base with the roof surface, and is generally parallel thereto, as shown in FIGS. 7 and 8. The louver spacer portion 22 and baffle supports 24 are preferably integral with the baffle 20 and are also spaced about 12" apart along the baffle 20.

The ridge vents 101 of this invention are relatively easy to install in shingle over ridge vent or standard applications. In the preferred embodiment, the ridge vent 101 is unrolled and disposed over an opening of a roof ridge. The baffles 14 are flexed, or otherwise reoriented, from a first direction to a second direction relative to the central panel portion 11, the roof, or both, as shown in FIGS. 4–8. Preferably the orientation step includes applying a support means for assisting the baffles to achieve the second position. In the preferred embodiments of this invention, the support means may be manual support means, such as clips, fasteners or stand-offs, or natural support means, such as employing ribs or areas of stress in the flexible member or ridge vent so that the baffles orient themselves while being applied to a roof ridge. Preferably laying the ridge vent 201 on a roof, causes contact between the baffle supports 24, which forces, or bends, baffles 20 into a position which is more vertical. Alternatively, a combination of manual and natural support means can be employed.

In the shingle-over ridge vent installation methods of this invention, a plurality of shingles can be disposed over a portion of the ridge vent 201 and both the ridge vent and the shingles can be simultaneously nailed to a roof substrate, such as plywood, studs, tongue and groove planks, or the like, to secure both the roof vent 201 and shingles in place. In the installation shown in FIG. 8, the shingles are layered over the fasteners of the adjacent shingle, such as to minimize exposure to water leakage. The shingles are preferably layered so as to leave the vent opening, or louvers 110, open. They should also not interfere with the Venturi action caused by the baffles 20. The ridge vent 201 can further include a foam insert (not shown), which can seal the end of the vent prior to completion of the installation.

Figure 9:
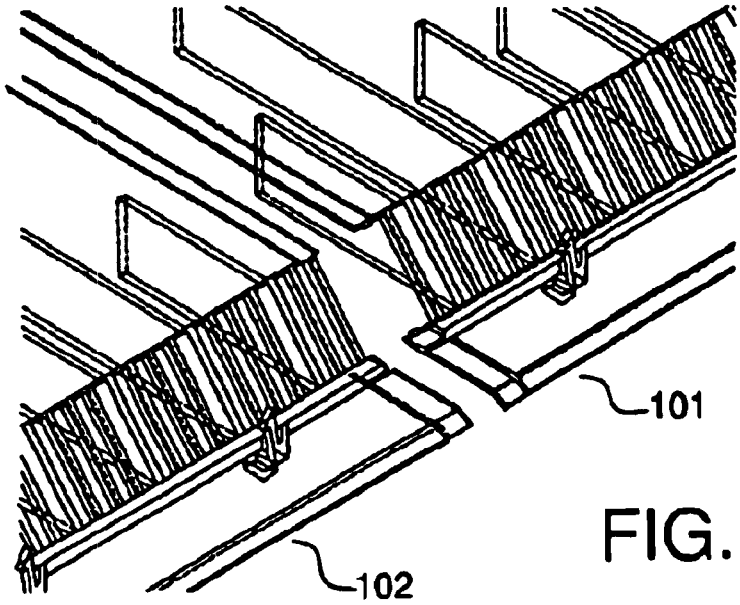
FIG. 9: is a front perspective phantom drawing of an index molding connection between two ridge vent sections.
Figure 10:
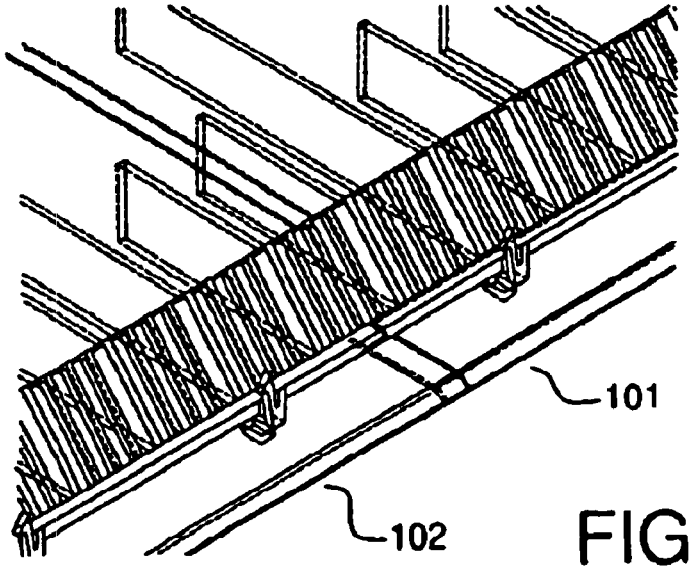
FIG. 10: is a front perspective phantom drawing of the ridge vent sections of FIG. 9 being melt bonded together.

This invention also contemplates a more efficient manufacturing process for making ridge vents, a shown in FIGS. 9 and 10. The preferred method includes a forming operation employing polymeric materials. The forming operation can include injection molding, extrusion or compression molding, for example. In a preferred embodiment, the ridge vent is made by index injection molding. In such a preferred embodiment, a mold 102 having upper and lower mold sections, shown in phantom in FIG. 9 is provided for forming a mold cavity. A quantity of polymeric material is disposed in the mold cavity and a first ridge vent section 101, also shown in phantom is formed in the mold cavity. Next, the first ridge vent section 101 is indexed so that it is substantially moved beyond the mold cavity but remains in contact with the mold 102. As shown in FIG. 10, a small stepped extension formed in the baffle 14 and central panel 11, can remain in the mold 102. Finally, a second quantity of polymer is disposed between the mold sections of mold 102 and a second ridge vent section is formed which is connected to the first ridge vent section 102. The cooled first ridge vent section can than be rolled up in lengths containing about 20–50 feet of vent material, which is then packaged in a paper or polyethylene wrap.

From the foregoing, it can be realized that this invention provides improved roof vents, methods of installation, and methods of manufacture. The roof vents of this invention have adjustable baffles, which can be laid flat for easier manufacturing and rolling, but which can be oriented in a vertical direction for providing negative pressure. Although various embodiments have been illustrated, this is for the purpose of describing, but not limiting the invention. Various modifications which will become apparent to one skilled in the art, are within the scope of this invention described in the attached claims.

What is claimed is:

1. A rollable ridge vent for covering an opening of a roof ridge, comprising:

an elongated flexible member having a central panel portion, a pair of longitudinal side portions and a pair of transverse ends;

said central panel portion comprising a plurality of support ribs for supporting said central panel portion above said roof;

each of said side portions containing a vent opening and a baffle disposed laterally from said vent opening;

each of said baffles being oriented in a first direction relative to said central panel portion for at least a period of time prior to installation and being oriented in a second direction relative to said central panel portion after said installation.

2. The ridge vent of claim 1 wherein said central panel portion is biaxially flexible.

3. The ridge vent of claim 2 wherein said first direction is relatively flat with respect to a roof said ridge vent is being placed upon.

4. The ridge vent of claim 3 wherein said second direction is more vertical than said first direction.

5. The ridge vent of claim 1 further comprising support means for assisting said baffles to be oriented from said first direction to said second direction.

6. The ridge vent of claim 5 wherein said support means comprises a clip, external standoff, stressed portion of said flexible member, or combination thereof.

7. A method of installing a ridge vent over an opening of a roof ridge, comprising:

providing a ridge vent including an elongated flexible member having a central panel portion, a pair of longitudinal side portions and a pair of transverse ends;

each of said side portions containing a vent opening and a baffle disposed laterally from said vent opening;

said central panel portion comprising a plurality of support ribs for supporting said central panel portion above said roof;

covering an opening of a roof ridge with said ridge vent;

orienting said baffles from a first direction to a second direction relative to said central panel portion; and affixing said ridge vent to said roof ridge so as to allow air to escape from beneath said central panel portion to ventilate a space beneath said roof.

8. The method of claim 7 wherein said orientation step comprises employing support means for assisting said baffles to achieve said second position.

9. The method of claim 7 wherein said baffles are oriented from said first direction to said second direction either manually with clips, fasteners or stand-offs, by employing a tendency of the flexible member to orient itself while being applied to said roof ridge, or a combination thereof.

10. The method of claim 7 further comprising disposing a plurality of shingles over a portion of said ridge vent.

11. The method of claim 10 further comprising nailing through a portion of said shingles and said roof vent to secure said shingles and said roof vent.

12. A method of making a ridge vent, comprising:

providing a mold having upper and lower mold sections forming a mold cavity therebetween;

disposing a first quantity of a polymeric material in said mold cavity between said mold sections;

forming a first ridge vent section in said mold cavity;

indexing said first ridge vent section so that it is substantially moved beyond said mold cavity but remains in contact with said mold;

disposing a second quantity of polymer between said mold sections; and forming a second ridge vent section which is connected to said first ridge vent section.

13. The method of claim 12 wherein said first ridge vent section is automatically indexed forward prior to forming said second ridge vent section.

14. The method of claim 13 wherein said mold sections open and close between forming said first ridge vent section and said second ridge vent section.

15. The method of claim 12 wherein said disposing steps comprise injection molding extrusion or compression molding.

16. A ridge vent for covering an opening of a roof ridge, comprising:

an elongated flexible member having a bi-axially flexible central panel, a pair of longitudinal side portions and a pair of transverse ends;

said pair of side portions each containing a baffle and a slotted vent opening for directing air current;

said central panel portion comprising a plurality of descending support ribs for supporting said central panel portion above said roof;

said baffle of each side portion being oriented in a first direction relative to a proximate part of said central panel portion in said roll for at least a portion of the time prior to installation, and being oriented in a second direction relative to said proximate part of said central panel portion after said installation on said roof ridge.

17. The ridge vent of claim 16 wherein said central panel portion is further supported by an internal, integral corrugated gusset.

18. The ridge vent of claim 16 wherein said elongated flexible member is manufactured by index molding.

19. The ridge vent of claim 16 wherein said flexible member comprises a filter.

20. The ridge vent of claim 19 wherein said filter is melt bonded to at least said support ribs.

21. A one-piece, rollable, ridge vent for covering an opening on a roof, comprising an elongated flexible member having a central panel portion comprising support means for supporting said central panel above a roof; a pair of side portions containing a vent opening and a baffle; said baffle being adjustable from a relatively flat position to a relatively vertical position with respect to said roof.

* * * * *

UNITED STATES PATENT AND TRADEMARK OFFICE

CERTIFICATE OF CORRECTION

PATENT NO. : 6,881,144 B2
DATED : April 19, 2005
INVENTOR(S) : Hansen et al.

It is certified that error appears in the above-identified patent and that said Letters Patent is hereby corrected as shown below:

Column 1,
Line 7, please delete "related" and insert therefor -- relates --.
Line 19, please delete "rooves" and insert therefor -- roofs --.

Column 2,
Line 27, please delete "loovers" and insert therefor -- louvers --.
Line 38, please delete "accompany" and insert therefor -- accompanying --.

Column 3,
Line 22, after the word "coil" please insert -- , --.

Column 4,
Line 30, after the word "plurality" please insert -- of --.

Column 5,
Line 2, please delete "shingle over ridge" and insert therefor -- shingle-over-ridge --.

Signed and Sealed this

Ninth Day of August, 2005

JON W. DUDAS
*Director of the United States Patent and Trademark Office*